US008240884B2

(12) United States Patent
Chen

(10) Patent No.: US 8,240,884 B2
(45) Date of Patent: Aug. 14, 2012

(54) MODULE STRUCTURE OF THE LED LIGHTS AND RADIATOR

(76) Inventor: Gao-Shan Chen, Tainan (TW)

( * ) Notice: Subject to any disclaimer, the term of this patent is extended or adjusted under 35 U.S.C. 154(b) by 309 days.

(21) Appl. No.: 12/322,912

(22) Filed: Feb. 10, 2009

(65) Prior Publication Data

US 2010/0202144 A1 Aug. 12, 2010

(51) Int. Cl.
*F21V 29/001* (2006.01)

(52) U.S. Cl. ..... 362/294; 362/249.027; 362/373; 362/800

(58) Field of Classification Search ..... 362/294, 362/249.02, 373, 800
See application file for complete search history.

(56) References Cited

U.S. PATENT DOCUMENTS

| | | | | |
|---|---|---|---|---|
| 7,338,186 | B1 * | 3/2008 | Wu et al. | 362/294 |
| 7,436,422 | B2 * | 10/2008 | Okazaki | 347/238 |
| 7,674,012 | B1 * | 3/2010 | Lin et al. | 362/249.02 |
| 7,740,380 | B2 * | 6/2010 | Thrailkill | 362/294 |
| 7,837,362 | B2 * | 11/2010 | Zhang | 362/373 |

* cited by examiner

*Primary Examiner* — John A. Ward
*Assistant Examiner* — Mark Tsidulko

(57) ABSTRACT

The module structure of the LED light and radiator comprises a cover and a light module. The penetrating holes and retaining holes are set at the bottom of the container in the inner side of the bottom cover. The screw holes are set around the fitting holes. The light module comprises an aluminum base set with many screw holes corresponding with the screw holes on the bottom cover, a radiator, LED lights which are on the circuit board and a lamp mask. A circuit board thereon set a lamp mask with screws is below the aluminum base, and the radiator is set on the aluminum base.

2 Claims, 7 Drawing Sheets

MODULE STRUCTURE OF THE LED LIGHTS AND RADIATOR

BACKGROUND OF THE INVENTION

1. Field of the Invention

This invention is related with the module structure of LED lights and radiator, especially for the light module comprises with aluminum base, radiators, LED lights and the lamp mask. The light module comprises LED lights and the radiator which can be fabricated and dismantled rapidly through the screws.

2. Description of the Related Art

"Assembled structure of large-sized LED lamps", the prior invention, which is granted by U.S. Pat. No. 7,338,186 as shown in FIGS. 1 and 2, the prior invention comprises a cover, a radiator, an aluminum base, lights and a lamp mask. Several heat-dissipating holes are set on four sides of the cover. The radiator is set on top of the aluminum base. Fix the cover and the aluminum base, and cover the radiator in the cover. The lights are set at the bottom of the aluminum base and then fixed to the lamp mask. The lights comprise the LED lights and the circuit board.

However, the "assembled structure of large-sized LED lamps" mentioned above has the following shortcomings:

1. There are no penetrating holes setting on the aluminum base which can not allow the heat produced by the radiator and the LED lights scattered. Moreover, when things or water get into the cover, it can not be drained.
2. There are no penetrating holes on the aluminum base, therefore, the heat-dissipating holes can be only set on sides of the cover. Otherwise, it will cause lots of things getting into the cover and can not be obviated.
3. When changing or fixing the radiator, the aluminum base and the cover need to be dismantled. The structure of the prior invention is more complicated, and the design of the radiator and the LED lights is inconvenient for being fabricated and dismantled separately.

SUMMARY

The present invention relates to a module structure of the LED lights and radiator which comprises a shell and a light module. A bottom cover set around with many heat-dissipating holes and a container which forms a containing space. Several penetrating holes and fitting holes are set at the bottom of the bottom cover. Several screw holes are set around the fitting holes. A light module comprises an aluminum base, radiator which is on the aluminum base, LED lights and a lamp mask. The screw holes on the surface of the aluminum base correspond to the screw holes on the bottom cover. A circuit board is set under the bottom of the aluminum base. The radiator is fixed on top of the aluminum base. LED lights are set on the circuit board which is at the bottom of the aluminum base. A lamp mask fixes the circuit board through screws.

BRIEF DESCRIPTION OF THE DRAWINGS

FIG. 3-1 is a perspective view for the present invention of the light module.

DETAILED DESCRIPTION OF THE INVENTION

Figure 1:
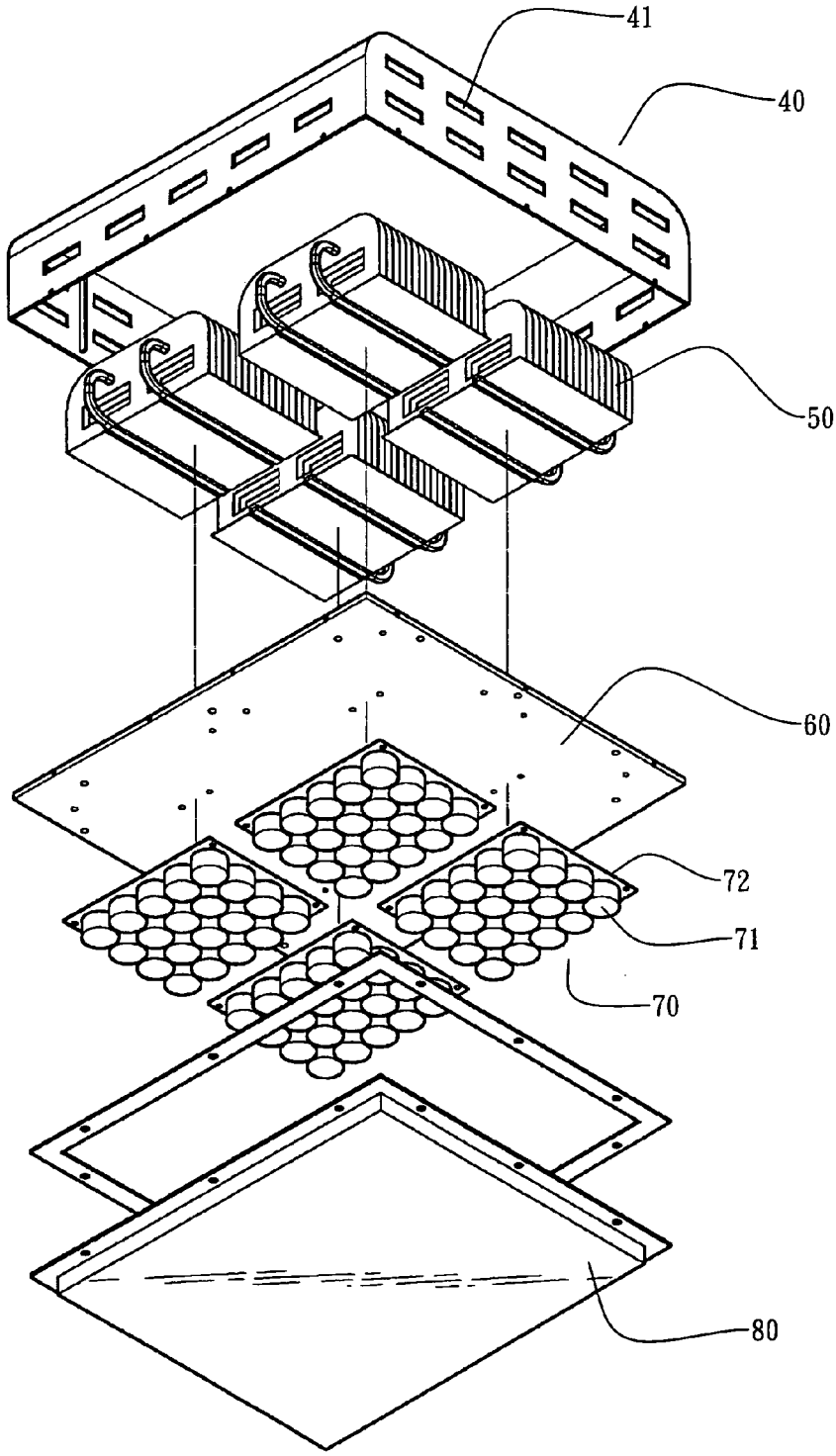
FIG. 1 PRIOR ART
FIG. 1 is a schematic drawing illustrating the prior invention.
Figure 2:
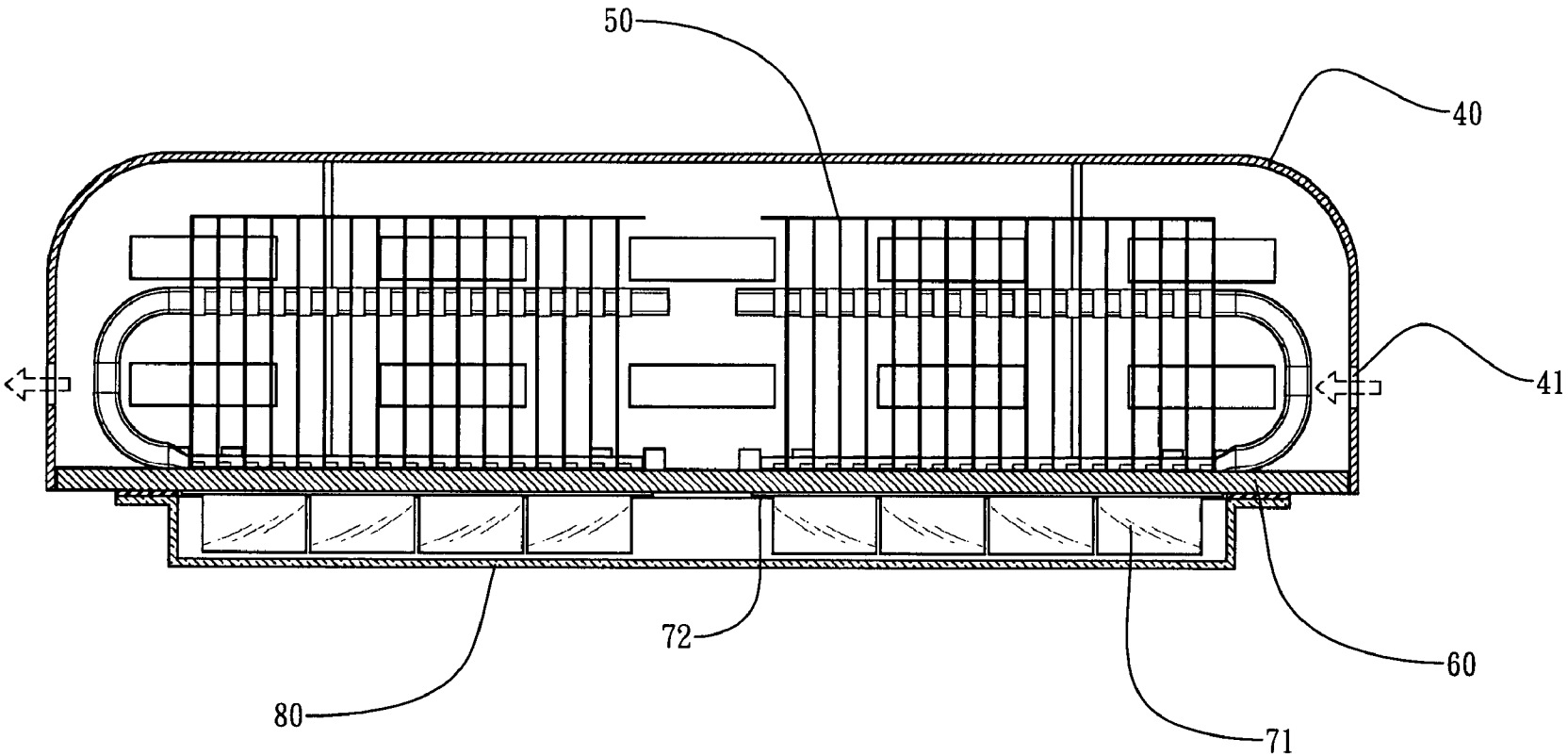
FIG. 2 PRIOR ART
FIG. 2 is a side view of the prior invention.

Referring to FIGS. 3 through 8, the module structure of the LED lights and radiator comprises a shell (10) and a light module (20). A shell (10) comprises a top board (11) and a bottom cover (12). Several heat-dissipating holes (111) which allow the air in are on the top board (11). A bottom cover (12) is set around with many heat-dissipating holes (124) and therein is a container (125) which forms a containing space. Several penetrating holes (121) and fitting holes (122) are set at the bottom of the bottom cover (12). Several screw holes (123) are set around the fitting holes (122).

Figures 1, 3:
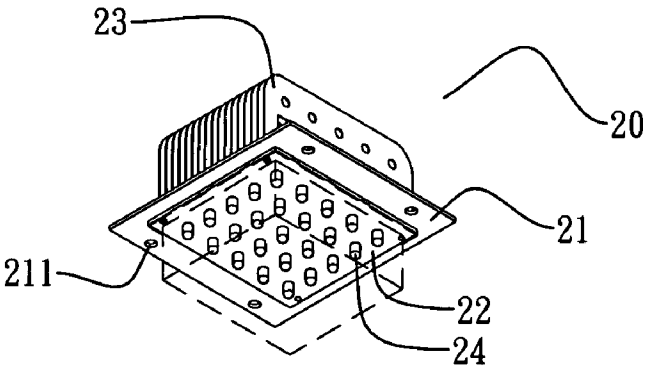
FIG. 3 is a schematic drawing illustrating the present invention of the light module.
Figure 3:
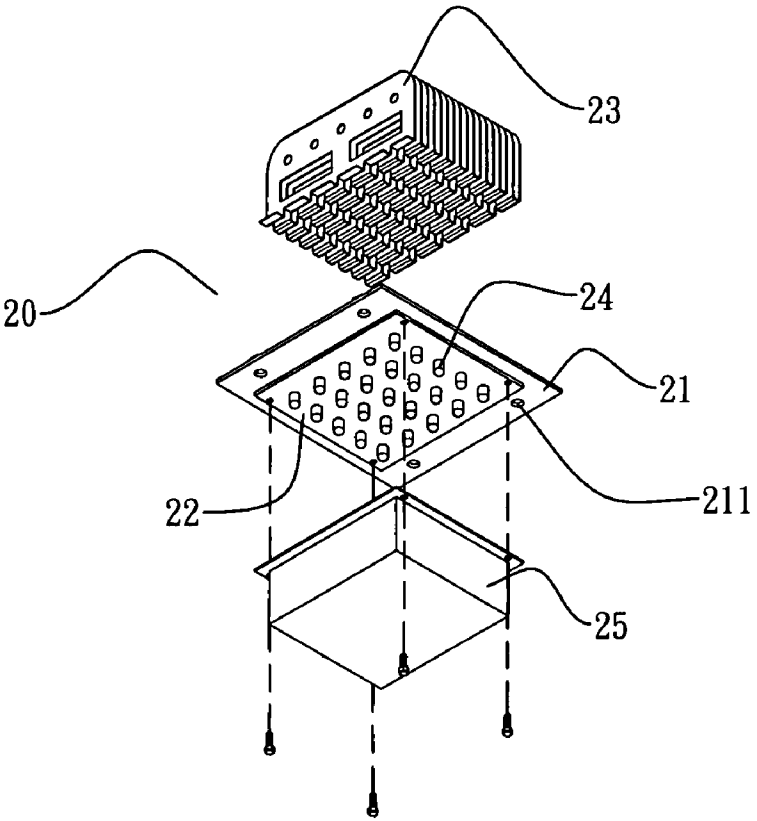
Figure 4:
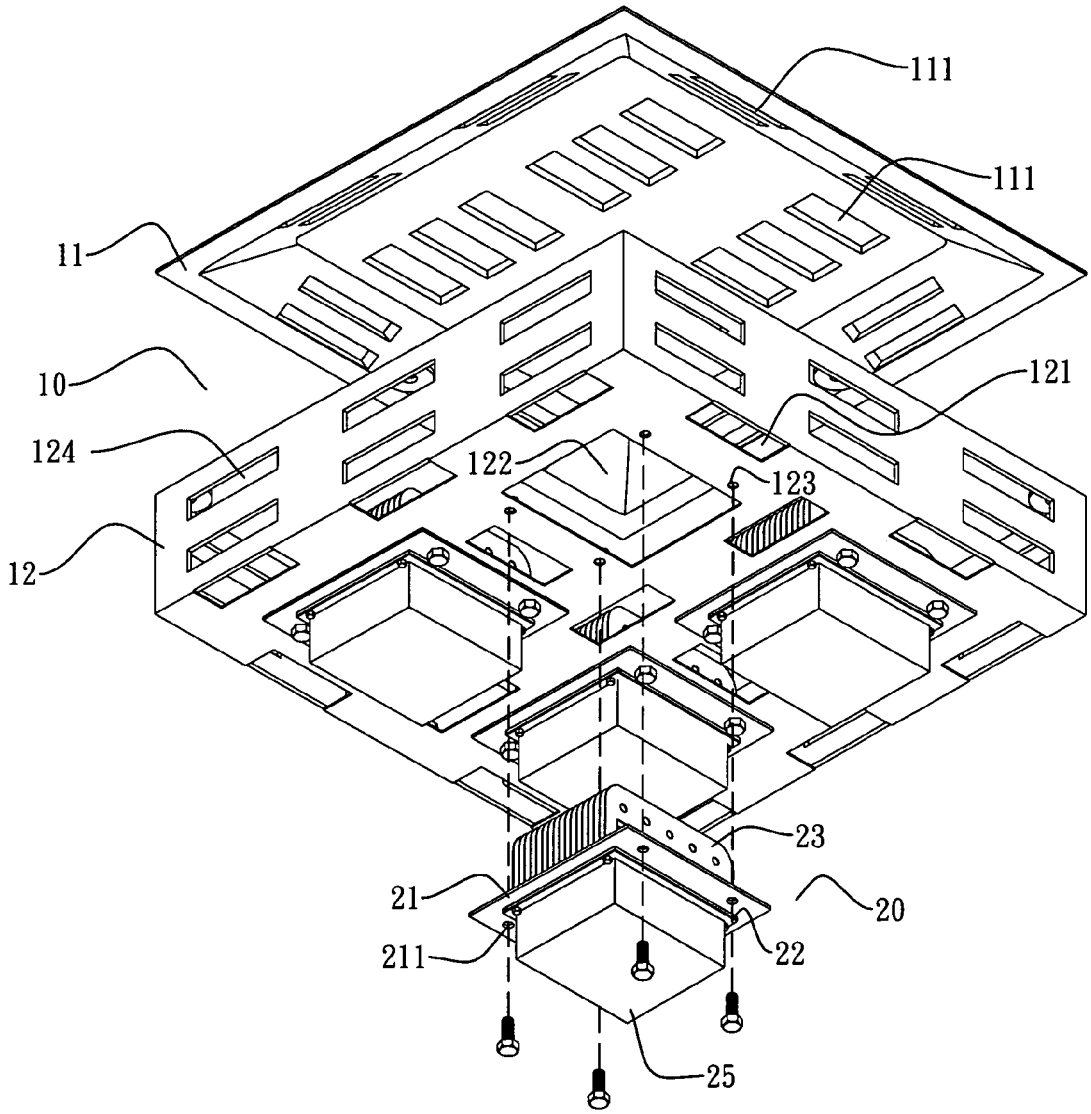
FIG. 4 is a schematic drawing illustrating the present invention.
Figure 6:
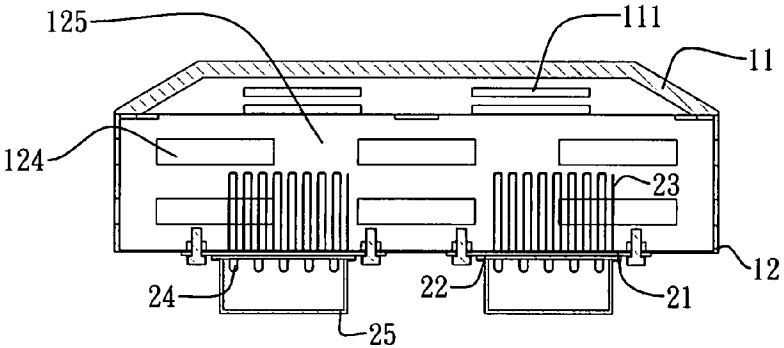
FIG. 6 is a side view of the present invention.
Figure 5:
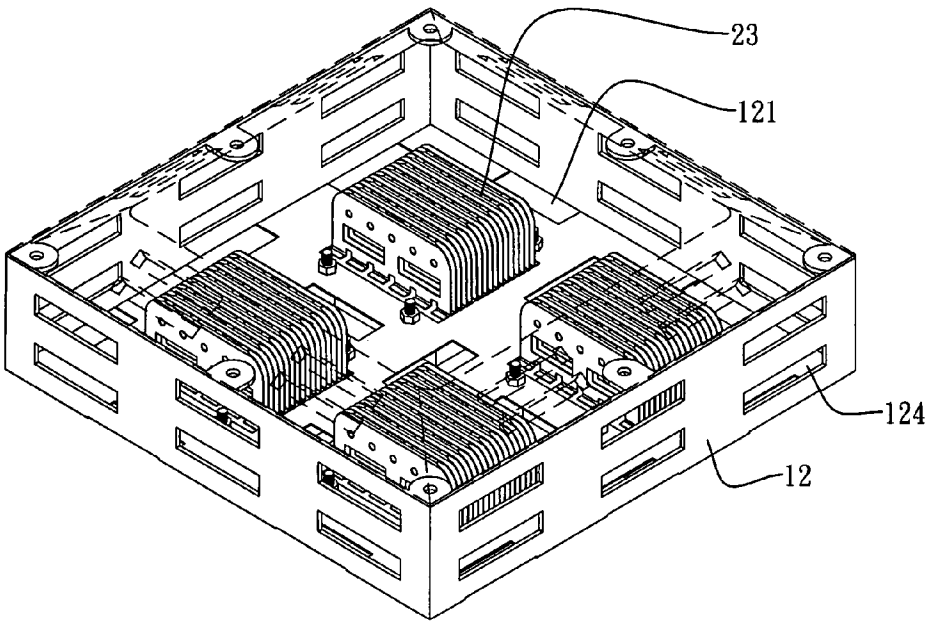
FIG. 5 is a perspective view for the present invention.

As shown in FIGS. 3 and 3-1, the light module (20) comprises a aluminum base (21), a radiator (23), LED lights (24) and a lamp mask (25). The area of the aluminum base (21) is bigger than the area of the fitting holes (122) setting at the bottom of the bottom cover (12). The screw holes (211) correspond to the screw holes (123) on the bottom cover (12). A circuit board (22) is set at the bottom. The radiator (23) is set on top of the aluminum base (21). The LED lights (24) are set on the circuit board (22) which is at the bottom of the aluminum base (21). A lamp mask (25) on the circuit board (22) is fixed through screws to cover the LED lights (24) in the lamp mask (25). As shown in FIG. 4, the radiator (23) of the light module (20) is on the top, the LED lights (24) and the lamp mask (25) are below; fix the screw holes (123) and the screw holes (211) correspondingly with screws, therefore, the light module (20) and the bottom cover (12) are connected. As shown in FIGS. 5 and 6, the area of the aluminum base (21) is bigger than the fitting holes (122), therefore, the aluminum base (21) can not move through the fitting hole (122), instead, it leans against the bottom of the bottom cover (12). The radiator (23) is set in the container (125) of the bottom cover (12) through the fitting hole (122).

Figure 8:
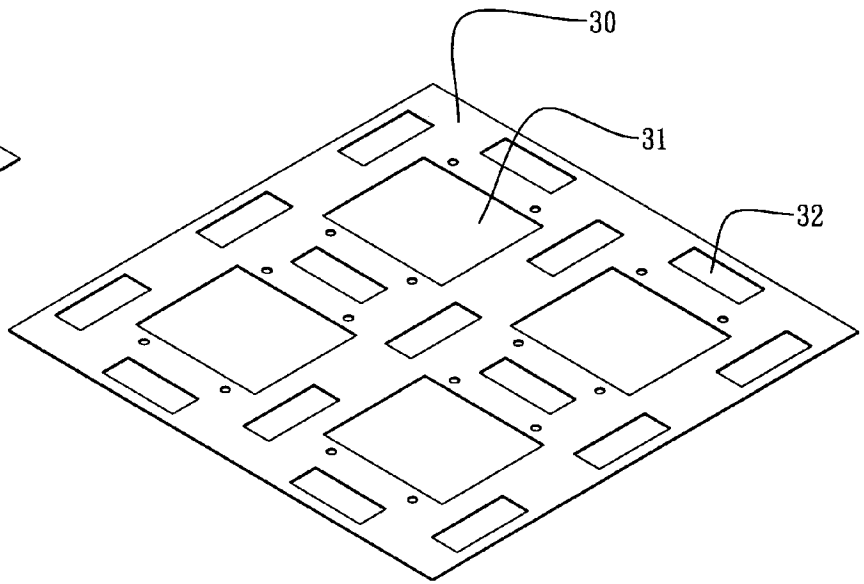
FIG. 8 is a schematic drawing illustrating the example for adding the penetrating holes on the retaining seat.
Figure 7:
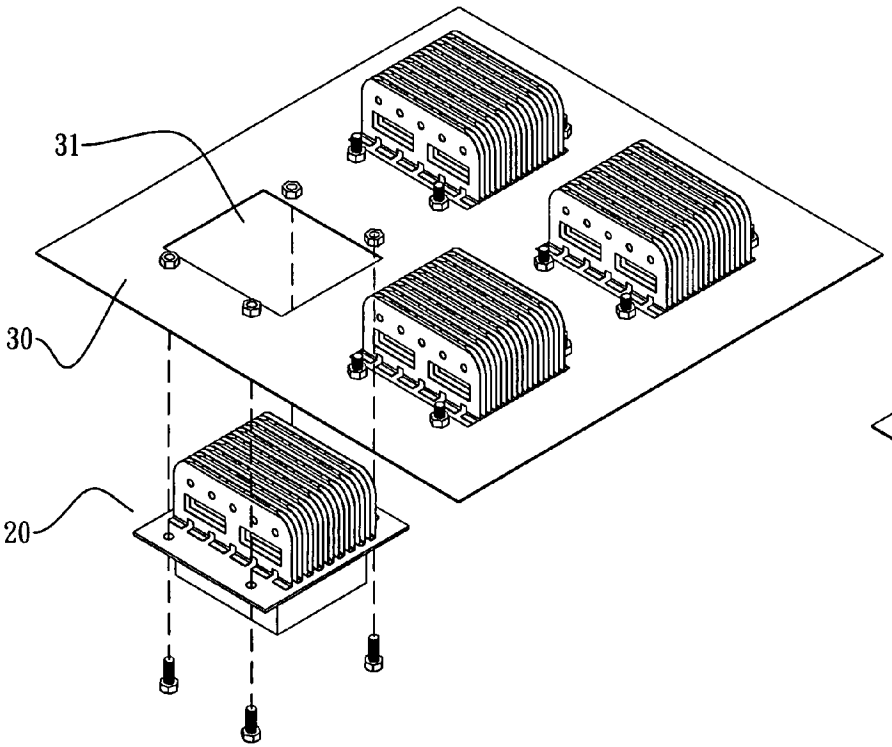
FIG. 7 is a schematic drawing illustrating the example of the present invention.

As shown in FIG. 7, this is the first example of the present invention. Replace the shell (10) with the retaining seat (30), and set the retaining holes (31) on the retaining seat (30). Set the light modules (20) in the retaining holes (31). Without the shell (10), the whole structure is better for heat-dissipating and water-draining, and it prolongs the using terms of the LED lights (24). As shown in FIG. 8, the penetrating holes (32) can be set around the retaining holes (31) of the retaining seat (30) to improve the effect of the water-draining.

Figure 10:
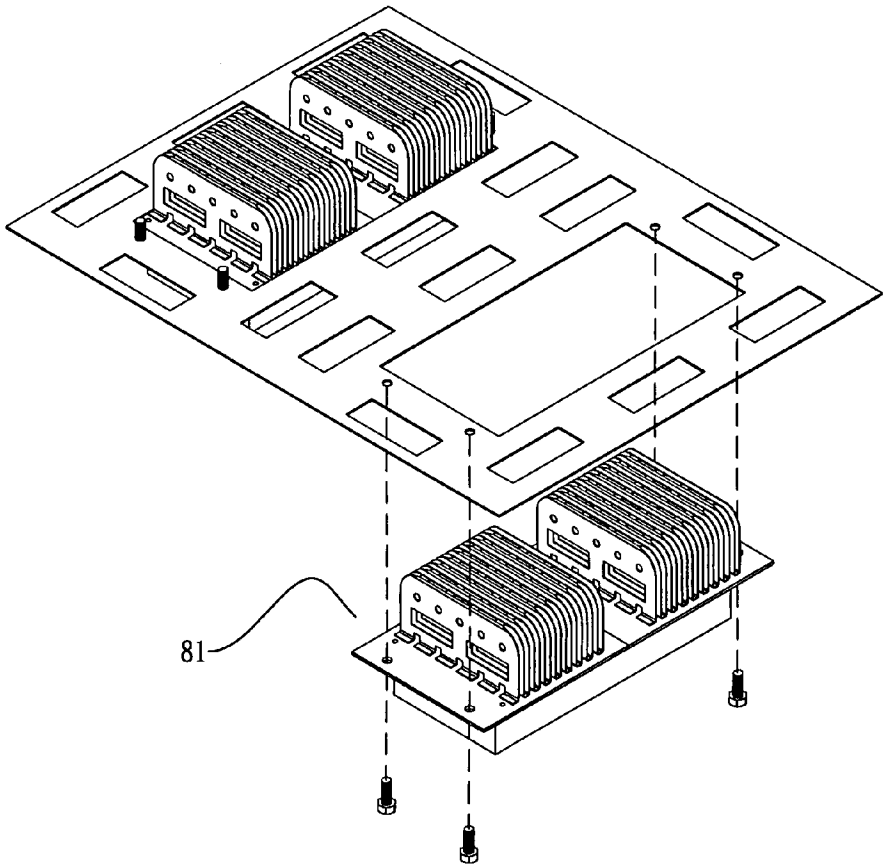
FIG. 10 is a schematic drawing illustrating the second example for setting the radiators on the aluminum base.
Figure 9:
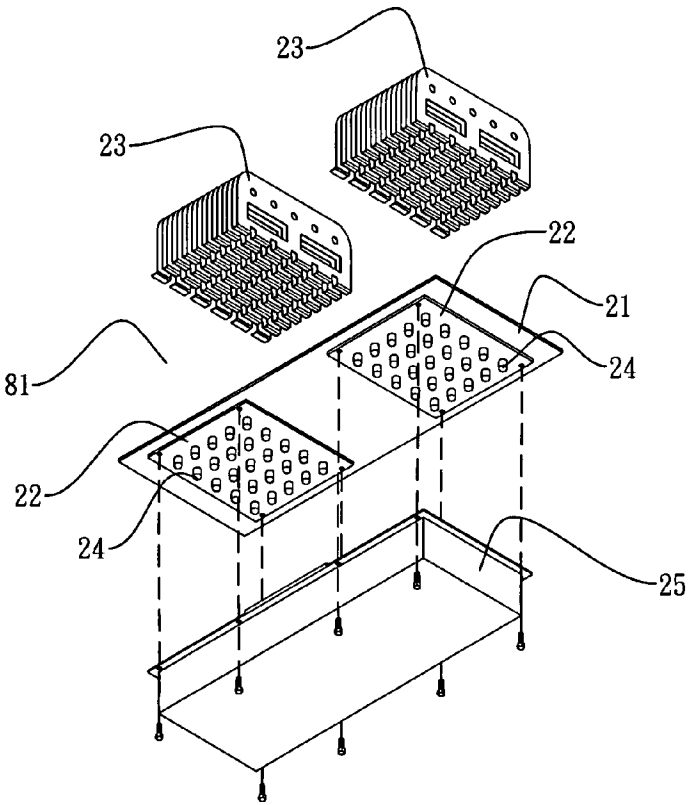
FIG. 9 is a schematic drawing illustrating the second example of the light modules.

As shown in FIGS. 9 and 10, the light modules (81) comprise more than two individual light modules (20), which are shown in FIG. 7. More than two radiators (23) can be set on top of the aluminum base (21), and more than two circuit boards (22) and LED lights (24) can be set at the bottom covered by a lamp mask (25).

The present invention mentioned above has the advantages as following:

1. Several penetrating holes (32) are set on the bottom board, therefore, it speeds up the heat-dissipating of the light module (20) through the convection between the top and the bottom boards. Also, it prolongs the using terms of the LED lights (24). When things or water get into the shell (10), it can be easily drained away through the penetrating holes (32).

2. Because several penetrating holes (32) are on the bottom board, the heat-dissipating holes (111) of the top board (11) may set not only on the side, but also on the top. It can speed up the heat-dissipating effect between two boards.

3. The light module (20) of the present invention is a single light module (20). The single light module (20) comprises an aluminum base (21), a radiator (23), LED lights (24) and a lamp mask (25). The light module (20) can be easily fabricated in the fitting hole (122) on the shell (10) or be easily dismantled. An individual light module (20) can be changed when fixing instead of taking down whole structure of the module and then installing parts of the module back. The present invention will save more time and reduce the difficulty on fixing than the prior invention.

I claim:

1. An LED light and radiator structure, comprising:

a shell, the shell comprising a top board with a plurality of heat-dissipating ventilation holes;

the shell further comprising a bottom cover, the bottom cover comprising a retaining seat and a container, the container orthogonal to the bottom cover, the retaining seat attached to the container to enclose a containing space, the container having a plurality of heat-dissipating holes;

the bottom cover having a plurality of penetrating holes, the bottom cover having a plurality of fitting holes;

a plurality of screw holes proximate to the fitting holes to fix a plurality of separate light modules through said fitting holes;

each light module comprising an aluminum base, a radiator, a circuit board with mounted LED lights and a lamp mask, the radiator mounted on a first side of the aluminum base, the circuit board mounted on a second side of the aluminum base, the aluminum base having screw holes aligned with screw holes on the bottom cover, the radiators disposed entirely within and protected by the shell;

a lamp mask, covering each circuit board, the lamp masks fixed with screws to the aluminum base;

the area of said aluminum base bigger than the area of said fitting holes;

said aluminum base leaning against the bottom of said bottom cover;

said radiator setting in said container of said bottom cover through said fitting holes.

2. An LED light and radiator structure as recited in claim 1, further comprising a plurality of said light modules each light module having at least two radiators set on a first side of an aluminum base, each light module having at least two circuit boards set at the bottom of an aluminum base; said circuits boards having LED lights covered with lamp masks.

* * * * *